US005589655A

United States Patent [19]

Gaulmier

[11] Patent Number: 5,589,655

[45] Date of Patent: Dec. 31, 1996

[54] ELECTRICAL INITIATION DEVICE WITH CONTACTOR

[75] Inventor: Andrë Gaulmier, Charenton Du-Cher, France

[73] Assignee: Giat Industries, France

[21] Appl. No.: 420,839

[22] Filed: Apr. 11, 1995

[30] Foreign Application Priority Data

Apr. 15, 1994 [FR] France ..... 94 04526

[51] Int. Cl.[6] ..... F41F 3/04; F41A 19/00

[52] U.S. Cl. ..... 89/1.814; 89/28.05; 89/135; 42/84; 42/106

[58] Field of Search ..... 89/1.813, 1.814, 89/28.05, 135; 42/84

[56] References Cited

U.S. PATENT DOCUMENTS

| | | | |
|---|---|---|---|
| 2,444,920 | 7/1948 | Davis, Jr. . | |
| 2,455,101 | 11/1948 | Stevens | 89/1.813 |
| 2,804,808 | 9/1957 | Humphrey | 89/135 |
| 3,078,803 | 2/1963 | Margraf et al. | 42/84 |
| 3,398,640 | 8/1968 | Apotheloz et al. | 89/1.813 |
| 3,490,332 | 1/1970 | Damm | 89/28.05 |
| 5,157,222 | 10/1992 | Le Mura et al. | 89/28.05 |

FOREIGN PATENT DOCUMENTS

| | | |
|---|---|---|
| 958433 | 3/1950 | France . |
| 2670573 | 6/1992 | France . |

*Primary Examiner*—Michael J. Carone
*Assistant Examiner*—Theresa M. Wesson
*Attorney, Agent, or Firm*—Parkhurst, Wendel & Burr, L.L.P.

[57] ABSTRACT

An electrical initiation device for an ammunition igniter (8) having a contactor (9) integral with a launch tube (1), wherein the contactor (9) is equipped with means to impart a rotational movement (11, 12) and a translational movement (13).

7 Claims, 1 Drawing Sheet

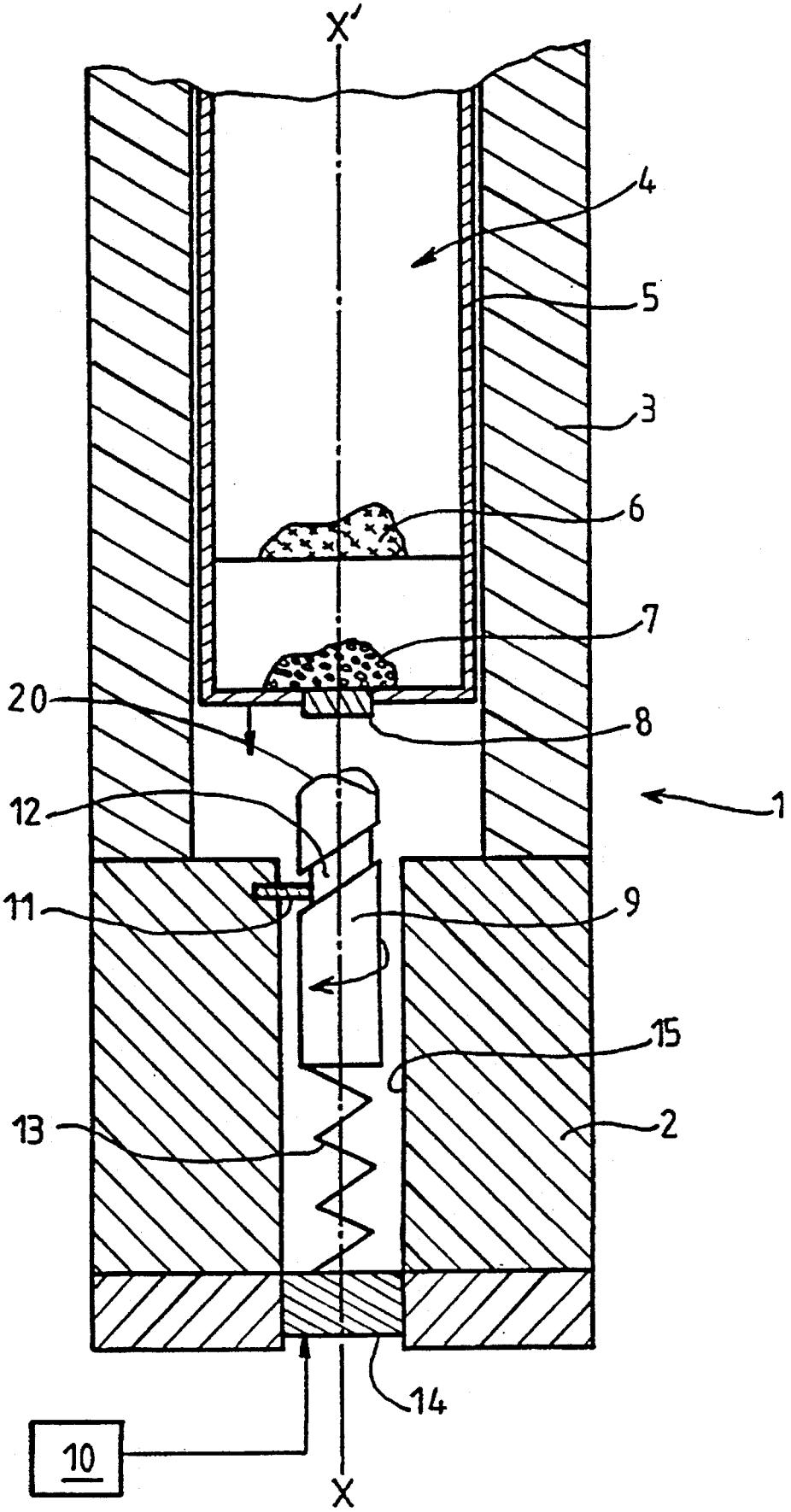
X'
4
5
3
6
7
20
8
12
1
11
9
15
13
2
14
10
X

ELECTRICAL INITIATION DEVICE WITH CONTACTOR

The technical scope of the present invention is that of electrically-operated ammunition firing devices with contactors.

In ammunition launching devices, such as decoy launches or smoke screen launches, a contactor placed at the bottom of a launch tube is conventionally used whereon the igniter of a munition comes to press through the effect of gravity. This igniter is thereafter ignited in a conventional manner by means of an electrical current. This contactor is fixed in place and becomes clogged up with dirt over time thereby causing the occasional non-ignition due to the lack of a real contact. Modifying the shape of the contactor does not bring any real improvement to this problem.

The aim of the present invention is to propose initiation means of an igniter which makes it possible to obtain an electrical contact however the launch tube is used.

The subject of the invention is therefore an electrical initiation device for an ammunition igniter having a contactor which is integral with the launch tube, characterised in that the contactor is equipped with means to impart rotational and translational movement.

According to one characteristic of the invention, the means to impart a rotational movement is composed of a finger sliding in a helicoidal groove.

According to one embodiment, the finger is integral with the tube and the helicoidal groove is produced on the contactor.

As an alternative embodiment, the finger is integral with the contactor and the helicoidal groove is produced in the launch tube.

According to another feature of the invention, the helicoidal groove is inclined at around 10° with respect to the longitudinal axis of the contactor.

According to a further feature of the invention, the means to impart a translational movement is composed of a spring applied to the base of the contactor which is made flush under the action of the weight of the munition.

According to yet another feature of the invention, the spring is of the helicoidal-type and is aligned along the longitudinal axis of the contactor as an extension of the latter.

A first advantage of the device according to the invention lies in the fact that it is so simple to produce.

Another advantage of the device lies in the fact that the launch tube is not altered in any significant manner.

Yet another advantage lies in the fact that the contactor may be used to transmit any type of information, for example, programming or piloting data and this with one or several contactors.

Other features and advantages of the invention will become apparent after reading the following descriptions given by way of illustration and accompanied by a drawing wherein the single FIGURE shows an axial cross-section of the launch tube. Preferably contactor 9 includes a head portion having raised edges 20 or the like to improved cleaning efficiency.

The axial cross-section of the launch tube 1 according to FIG. 1, shows the integration of the means according to the invention onto its base 2, the assembly having a longitudinal axis X–X'.

The actual launch tube 3 is partly shown and receives a munition 4 wherein the envelope 5 encloses a propellant powder charge 6, a booster pyrotechnic composition 7 and an igniter 8 arranged at the base and designed to ignite the composition 7. The munition 4 is partly shown and it is of the electrical initiation type.

To this end, the base 2 bears a contactor 9 whereon the munition 4 comes to press through the effect of gravity to electrical initiate the igniter 8 by means of an electrical circuit 10.

According to the invention, the contactor 9 is equipped with a means to impart a rotational movement composed of a finger 11 integral with the base 2 and cooperating with a helicoidal groove 12 produced on the said contactor 9. The gradient of this groove 12 is chosen so as to obtain a rotation of the contactor 9 however strong the friction between the munition 4 and the actual launch tube 3. As an illustration, the gradient of the groove 12 may be on the order of 10°, a value which also enables the system to be reversed. This value is generally chosen according to the friction coefficient of the materials used. The depth of this groove 12 is chosen so as to impart sufficient rotation to the contactor 9, for example, between one or two revolutions. The contactor is also subjected to the action of a means to impart a translational movement provided by a helicoidal spring 13 arranged between the base of the contactor 9 and a plug 14 screwed into the base 2. Naturally, the contactor 9 slides in a longitudinal housing 15 produced in the base 2 and whereof their respective sizes are are adjusted so as to ensure the degree of rotation and translation required. The stiffness of the spring 13 is determined according to the mass of the type of munition 4 to be launched by means of this launch tube 1. The helicoidal spring 13 and the plug 14 are made from a material which is a good conductor of electricity.

The device operates as follows. The munition 4 is inserted into the actual launch tube 3; through the effect of gravity the munition slides down and the igniter comes to press on the contactor 9. The weight of the munition 4 forces the contactor 9 into a rotational and translational movement, which causes the contactor to rub against the igniter 8 thereby cleaning it. Preferably contactor 9 includes a head portion having raised edges 20 or the like to improved cleaning efficiency. A real electrical contact is therefore obtained and the improved priming of the charge 6 is ensured.

Naturally, the finger 11 could be made integral with the contactor 9, the groove 12 being in this case produced on the wall of the housing 15 of the base 2. The shape of the head of the contactor 9 may be, moreover, designed so as to ensure the optimum cleaning of the contact surface of the igniter 8 and may, for example, have a shallow axial bore to give it the shape of a firmer chisel with cutting edges.

The invention may be applied to any armament of small, medium or large calibre using electrical contact initiation.

I claim:

1. An electrical initiation device for an ammunition igniter, comprising:

a contactor located in a launch tube, the contactor being equipped with means to impart translational movement and means to impart rotational movement, both the translational and rotational movement being imparted to the contractor by the weight of the ammunition on said contactor, and the contactor further being equipped with a head including cleaning means for abutting against and cleaning a contact surface of the ammunition igniter.

2. An initiation device according to claim 1, wherein the means to impart a rotational movement comprises a finger sliding in a helicoidal groove.

3. An initiation device according to claim 2, wherein the finger is integral with the tube and the helicoidal groove is impressed on the contactor.

4. An initiation device according to claim 2, wherein the finger is integral with the contactor and the helicoidal groove is impressed on the launch tube.

5. An initiation device according to claim 2, wherein the helicoidal groove is inclined at about 10° with respect to a longitudinal axis of the contactor.

6. An initiation device according to claim 1, wherein the means to impart a translational movement comprises a spring applied to a base of the contactor which is compressed under the action of the weight of the ammunition.

7. An initiation device according to claim 6, wherein the spring is of the helicodial-type and is aligned along a longitudinal axis of the contactor as an extension of the latter.

* * * * *